United States Patent [19]

Gray

[11] 4,295,696

[45] Oct. 20, 1981

[54] STRAIN RELIEF FOR CONNECTOR WIRES

[75] Inventor: Vincent F. Gray, Oklahoma City, Okla.

[73] Assignee: Western Electric Company, Incorporated, New York, N.Y.

[21] Appl. No.: 104,241

[22] Filed: Dec. 17, 1979

[51] Int. Cl.[3] ..... H01R 13/58

[52] U.S. Cl. ..... 339/17 C; 339/103 M; 339/176 MF

[58] Field of Search ..... 339/17 F, 176 MF, 98, 339/99 R, 17 C, 103 R, 107, 103 M, 128, 196 M

[56] References Cited

U.S. PATENT DOCUMENTS

| | | | |
|---|---|---|---|
| 3,622,943 | 11/1971 | Reimer | 339/103 |
| 3,907,396 | 9/1975 | Huber | 339/103 R |
| 3,960,425 | 6/1976 | Kirk et al. | 339/103 M X |
| 4,054,348 | 10/1977 | Stroupe et al. | 339/176 MF X |
| 4,060,295 | 11/1977 | Tomkiewicz | 339/176 MF X |
| 4,130,334 | 12/1978 | Anderson | 339/103 M |
| 4,173,387 | 11/1979 | Zell | 339/196 M |

OTHER PUBLICATIONS

"Self-Locking Strain Relief Device", Melnychenko, IBM Technical Discl. Bull., vol. 10, No. 10, Mar. 1968, pp. 1519–1520.

Western Electric Co., Dwg. 840984934.

*Primary Examiner*—Eugene F. Desmond

*Attorney, Agent, or Firm*—R. P. Miller

[57] ABSTRACT

A snap-in strain relief (10) is provided for insulated cable wires (23) spread across and solder connected to thin metallic terminals (22) formed on a printed circuit board (11). The strain relief is constructed in the shape of a bar (32) having a projecting cleat (36 or 58) at one end which fits into a slot (37) or hole (62) formed in an edge section of the circuit board, and a projecting post (44) with a headed lobe (46 or 57) at the other end which is force-fitted into a hole (43) formed in the circuit board. Standoffs (47 and 48) are formed on the underside of bar to insure that the bar does not crush the insulation of the wires while applying a force to hold the wires and force isolate the soldered connections against pulling forces imparted to the cable (24).

1 Claim, 5 Drawing Figures

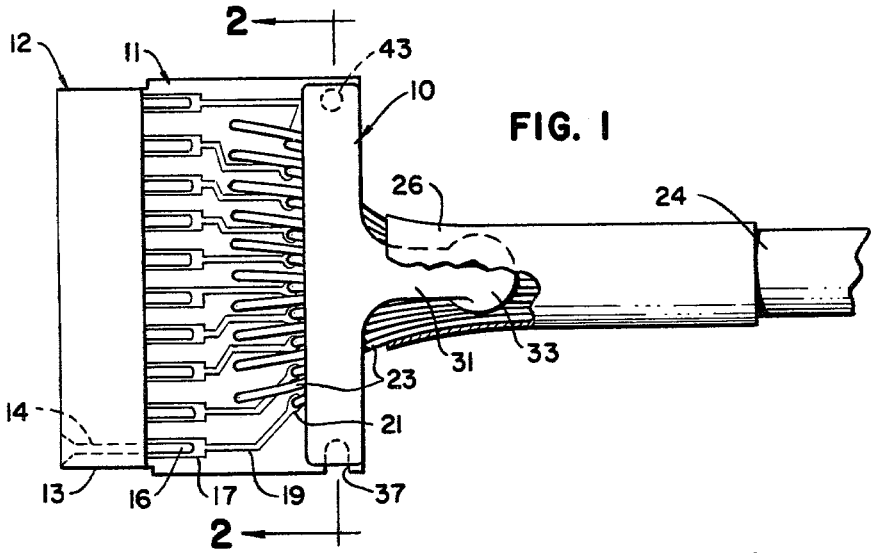
FIG. 1
FIG. 2
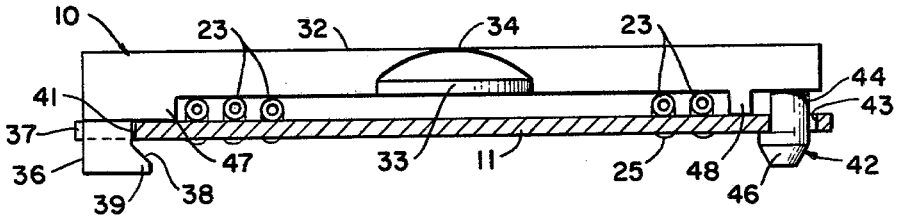
FIG. 3
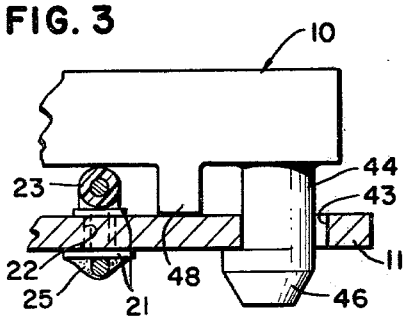
FIG. 4
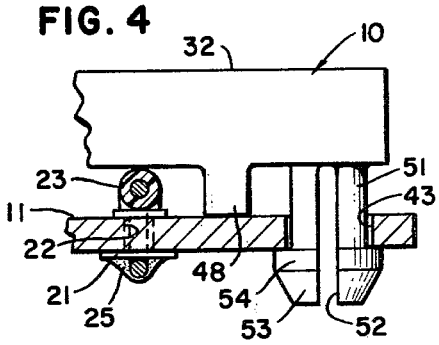
FIG. 5
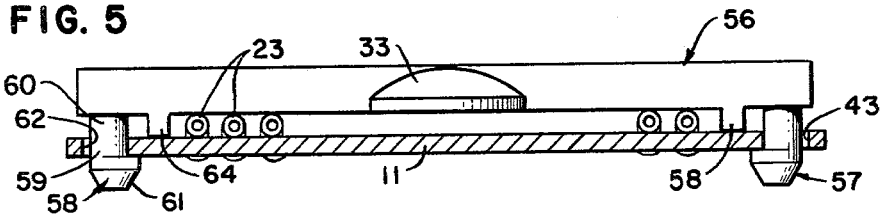

STRAIN RELIEF FOR CONNECTOR WIRES

FIELD OF THE INVENTION

This invention relates to strain reliefs for connector wires, and more particularly to a strain relief with fastener elements that may be readily snapped into an assembled position on a connector device to relieve pulling forces imparted to cable wires secured to the connector device.

BACKGROUND OF THE INVENTION

At present solid state devices are extensively used in communication equipment wherein the devices are included in modular assemblies or are mounted on circuit boards which are electrically interconnected by connectors attached to multi-wire cables. These multi-wire cables may be secured to a connector by soldering or bonding operations that are adequate to attain the necessary electrical characteristics, but these securing operations are relatively weak and subject to failure upon mechanical pulling forces being imparted to the wires. During the assembling, testing, use and maintenance of these equipments, the connectors are frequently pulled from the modules and circuitboards. In order to protect the soldered joints, strain relief devices have been developed.

One type of connector commonly used in telecommunication equipment comprises a series of sockets located in a plastic housing which is secured to a small printed circuit board having an array of terminal pads onto which trailing conductive segments of sockets are solder secured. Cable wires are also solder secured to other terminal pads formed on the circuit board. The terminal pads are in the form of thin films of metal; hence, wires solder secured to such pads are susceptible to separation upon excessive pulling forces being imparted to the wires. In order to provide strain relief against pulling forces, a strain relief in the form of a bar has been developed, which bar is riveted and fixed to the circuit board.

The general problem of strain relieving soldered connections between wires and terminal pads on circuit boards has led to the development of several types of strain relief devices. In U.S. Pat. No. 3,622,943 to W. A. Reimer, there is disclosed a cable clamp mounted on a printed circuit board which consists of a pair of block halves having facing slots for accommodating and securing a section of sheathed cable. The block halves are secured together by screws and then the assembled block is secured to the printed circuit board by screw fasteners. In this device the cable sheath is collapsed around the wires to provide strain relief for the individual wires which are solder secured to terminals formed on the circuit board.

U.S. Pat. No. 3,907,396 to J. H. Huber shows a strain relief clamp comprising two bar-like members having inwardly directed lances. The bar-like members are secured together by screws so that the lances bite into the outer insulation of the cable to provide a mechanical strain relief. Another strain relief construction is shown in U.S. Pat. No. 4,130,334 to B. W. Anderson wherein a clamping bar is secured by screws against a flat cable. Spacers are interposed between the clamping bar and a termination plate to prevent excessive crushing of the insulation on the flat cable.

SUMMARY OF THE INVENTION

The present invention contemplates, among other things, a quick snap-in strain relief in the form of a bar having locking members formed at opposite end sections which are readily assembled to a planar member, such as a printed circuit board, to lock the bar against wires fanned across the planar member and provide a strain relief against pulling forces imparted to the wires.

More particularly, the invention is especially useful as a strain relief for a connector of the type having a jack section secured to a small printed circuit board. This type of connector includes conductive sockets that are solder secured to circuit paths on a board, which paths run to terminal pads that are solder connected to an array of wires emanating from a cable sheath. The strain relief is configured in the shape of a "T" with a stem having a knob which is fitted under the cable sheath. In one embodiment of the invention, the crossarm of the "T" is provided at one end with a C-shaped projection which clamps onto one edge of the board, while the other end of the crossarm is provided with a projecting stud having a lobe-like head which is snapped into a hole formed in the board. The assembled T-shaped relief holds the wires against the board and substantially isolates the soldered ends of the wires from pulling forces applied to the cable sheath.

A preferred embodiment of the invention contemplates a strain relief crossarm having a pair of locking members, each in the form of a frustum of a cone mounted in offset relation to the axis of a cylindrical post extending from the crossarm. The offset locking members extend from the posts toward each other so that the distance between the extending sections is less than the distance between a pair of holes in the circuit board. The strain relief is assembled on the board by aligning the locking members above the holes, and pressing and slightly deflecting the center of the arm to push the cone surfaces against facing edges of the respective holes, whereupon the locking members are deflected outwardly and snap into the holes. A pair of transverse standoff bars are formed on the undersurface of the crossarm to engage the surface of the circuit board and limit the force applied to the engaged strain relieved wires.

BRIEF DESCRIPTION OF THE DRAWINGS

Other features and advantages of the invention will be apparent upon consideration of the following detailed description and drawings, wherein FIG. 1 is a top view of a connector secured to an array of cable wires which are held in position by a strain relief embodying the principles of the present invention;

FIG. 2 is an end view of the strain relief showing fastener elements for securing the relief to a small circuit board which forms part of the connector;

FIG. 3 is an enlarged side elevational view of one of the fastener elements which is force fitted into a hole formed in the circuit board;

FIG. 4 is an enlarged side elevational view of an alternative force-fitted fastener for securing the strain relief to a circuit board; and FIG. 5 is an end view of a modified strain relief, embodying the principles of the invention, wherein the strain relief is secured in place by a pair of snap-in fasteners.

SUMMARY OF THE INVENTION

Referring to FIG. 1, a strain relief 10 embodying features of the present invention is shown as being clamped to a small circuit board 11 forming part of a connector 12. The particular connector 12 is shown to illustrate one application of the principles of the invention, and it will be readily appreciated that the strain relief may be readily used in other installations where it is desired to protect solder or other fragile secured wire connections from detrimental pulling forces. There are many types of electrical and solid state equipments made up of circuit boards or modules which are interconnected with other circuit board or modules by providing thin metallic terminal pads on the respective circuit boards and/or modules and securing interconnecting wires through the agency of relatively fragile bonds. In all such instances, it is manifest that these fragile connections be protected from any damaging mechanical forces that may be encountered in assembling, using, maintaining and servicing the equipments.

The connector 12 is of a type that finds wide use in the manufacture of various electronic telephone switching equipment. The connector includes a plastic housing 13 having tiers of small electrical sockets 14 which serve as jacks to receive prongs extending from other connectors. Each socket 14 has a trailing extremity 16 that is bonded to a terminal pad 17 formed on the circuit board 11. Each terminal pad 17 is formed integral with a conductive path 19 running to a second terminal pad 21 formed about a hole 22 formed in the board 11. An insulation stripped end of one of a plurality of wires 23 is inserted in a hole 22 (see FIG. 3) and then crimped to the underside of the board, whereafter solder 25 is applied to the crimped end and the terminal pad. This solder connection is relatively fragile and must be protected against pulling forces that may be applied to the wires 23. The wires 23, all of which have ends that are crimped and soldered to terminal pads form part of a cable 24 having a sheath 26. It will be noted that the wires 23 are arrayed across one face of the board and are clamped by strain relief 10 to effectively isolate the solder connections from any pulling forces applied to the cable 24.

The strain relief 10 may be molded from a slightly resilient plastic and is formed in the general configuration of a "T" which includes a stem section 31 and a crossarm section 32. As illustrated in FIGS. 1 and 2, the base of the stem section 31 terminates in an enlargement 33 which has a knob-like projection 34. This enlarged base and knob may be taped to the bundle of wires 23 or fitted beneath the sheath 26 of the cable so as to hold the end of the cable in position relative to the strain relief 10. In the prior art, T-shaped strain reliefs with stems similar to stems 31 have been utilized, but these strain reliefs have been riveted to circuit boards, such as circuit board 11. The improved strain relief forming the subject matter of the present invention may be quickly assembled or disassembled because it includes holding or locking elements which may be readily assembled and disassembled from a planar member, such as a circuit board.

More particularly, the crossarm 32, see FIG. 2, is provided with a projecting cleat-like element or boss 36 which may be fitted within a slot 37 formed in or near one edge of the circuit board 11. The boss 36 is cut back along beveled line 38 to form a nub or lobe 39 which overlies the circuit board 11 so as to lock this end of the crossarm 32 to the edge of the circuit board. It will be noted that the bevel line section 38 runs into a straight section or post 41 which is approximately equal in length to the thickness of the board 11.

The other end of the crossarm 32 is secured to the board 11 by a force-fitted projection 42, see FIGS. 2 and 3, extending through a hole 43 formed in the board. More specifically, this second projection 42 comprises a cylindrical boss or post 44 terminating in a lobe 46 which is formed in the shape of a frustum of a cone. The axis of this cone is offset from the axis of the boss 44 so that the lobe extends beneath the underside of the circuit board 11. The degree of offset of the lobe 46 is selected so that the boss and lobe may be deflected into position so that the lobe passes through the hole 43 and then snaps to a position underlying the board 11. The lobe 46 and the nub 36 cooperate and act as cleats to lock the strain relief to the board 11.

It will be noted from FIG. 2 that the crossarm 32 has a spacer or standoff section 47 which bears against the board 11 and holds the underside of the crossarm from crushing the insulated wires 23. The other end of the crossarm 32 is held spaced from the other edge of the circuit board by a transverse bar 48 which acts as a standoff. It will also be noted that the standoff 48 holds the crossarm in a position so that the lobe 46 is held in close proximity to, or engaged against, the underside of the board.

In use of the strain relief, the knob 34 is taped to the wires 23 or fitted under the sheath 26. Next, the assembling operator merely slips the cleat-like projection 36 into the slot 37 and then applies a force to the other end of the crossarm to force the cone-like surface of the lobe against the edge of the hole which deflects the lobe as it snaps through the hole 43. Inasmuch as the distance between facing edges of the lobe 46 and the nub 39 are less than the distance between the inner wall of the slot 37 and the wall of the hole 43, the lobe will snap into a position underlying the board as it passes through the hole to lock the strain relief to the board 11. The wires 23 which are arrayed across the surface of the board 11 are thus pressed against the surface of the board and held against any detrimental forces which may be applied to the cable 24, such as would be encountered in a disconnect of the connector 12.

Another embodiment of the invention is disclosed in FIG. 4 wherein a quick connect is used to secure the crossarm 32 against the wires 23. In this instance, a cylindrical boss 51 is provided having a diametric slot 52. Again a lobed head 53 is provided which is configured in the form of a frustum of a cone having its central axis aligned with the central axis of the cylindrical boss 51. In this instance, a cylindrical base 54 of the lobe 53 is selected to have a diameter slightly larger than the diameter of the hole 43. With a strain relief so constructed, the nub 39 end of the crossarm 32 is again assembled in a slot 37 formed in a circuit board 11. A pressing force is then applied to the other end of the crossarm to push and deflect the lobed sections 53 toward each other and through the hole 54 whereafter the lobe sections snap outwardly so that the cylindrical base 54 overlies the perimeter of the hole 43. In this instance, the crossarm 32 is again provided with a standoff bar 48 to restrict the holding force applied to the insulated wires 23.

A simplified preferred embodiment of the invention is shown in FIG. 5, wherein a strain relief 55 having a crossarm 56 is again provided at one end with a lobed locking member 57 and a standoff bar 58 similar to the locking member 42 and the standoff bar 48 shown in FIGS. 1, 2 and 3. In this instance, the other end of the strain relief crossarm is provided with a second locking member 59 similar in construction to locking member 57. Locking member 59 comprises a cylindrical post 60 terminating in a lobe or nub 61, which again is formed in the shape of a frustum of a cone. The axis of this cone is offset from the axis of the post 60 so that the lobe 61 in the assembled position extends toward lobe 57 and beneath the underside of the circuit board.

The circuit board 11 is provided with a second hole 62 to receive the locking member 59. A second standoff bar 64 is provided to engage the board 11. The facing sections of the lobed locking members 57 and 59 are spaced apart a distance which is slightly less than the distance between the more closely adjacent sections of the walls of the holes 43 and 62 so that when the strain relief 56 is pressed toward the board 11, the cone-like locking members 57 and 59 will be deflected away from each other a distance sufficient to permit the passage of the lobes through the holes. As the lobes pass through the holes, the locking members will snap into position underneath the board to lock the strain relief to the board. The standoffs 58 and 64 engage the board to limit the movement of the crossarm 56 so that the crossarm 56 firmly engages and strain relieves the wires without crushing the insulation thereon. The standoffs also function to hold the lobes in close proximity to, or engaged with, the underside of the board.

What is claimed is:

1. A connector and strain relief assembly, which comprises:

a flat circuit board for mounting the connector, said board having an array of terminals interconnected to said connector;

a cable comprising a jacket and a plurality of insulated wires, the ends of which extend beyond the end of the jacket and are fanned across the board and solder secured to the terminals;

a T-shaped strain relief having a crossarm overlaying the wires and a stem with a knob formed thereon and positioned beneath an end section of said cable jacket, the crossarm of said strain relief being provided at one end section thereof with a projecting member that is undercut along one edge to form a nub, said undercut extending as a bevel surface to a straight line post section which is approximately equal in length to the thickness of the board, and the other end section of the crossarm being provided with a projecting cylindrical boss having a frusto-conical head, the central axes of the boss and the head being offset with respect to each other so that a lobe portion of the head overhangs the boss;

said board having a slot formed across one edge to receive the projecting member with the nub thereof underlying the circuit board, and said board having a hole formed therein to receive the projecting boss with the lobe portion underlying the circuit board, said hole and cylindrical boss being so positioned that the lobe deflects the boss when the strain relief is pressed to move and snap the lobe through the hole into the circuit board underlying position, said movement of the frusto-conical head through the hole acting to move, the bevel surface of the projecting member along the bottom edge of the slot to seat the straight line post section, against the bottom of the slot, and means projecting from the crossarm to limit the movement of the crossarm toward the circuit board and thus limit the strain relief force applied to the array of wires by the assembled circuit board and strain relief while holding both the overhanging lobe portion of the frusto-conical head and the juncture of bevel surface with the post in close proximity to the underside of the board.

* * * * *